US007251855B2

(12) United States Patent
Hayashi et al.

(10) Patent No.: US 7,251,855 B2
(45) Date of Patent: Aug. 7, 2007

(54) ELECTRIC VACUUM CLEANER

(75) Inventors: Akimitsu Hayashi, Matsumoto (JP); Tetsuhiko Shimiuzu, Matsumoto (JP)

(73) Assignee: Izumi Products Company, Nagano (JP)

( * ) Notice: Subject to any disclaimer, the term of this patent is extended or adjusted under 35 U.S.C. 154(b) by 671 days.

(21) Appl. No.: 10/725,718

(22) Filed: Dec. 2, 2003

(65) Prior Publication Data

US 2004/0107531 A1 Jun. 10, 2004

(30) Foreign Application Priority Data

Dec. 3, 2002 (JP) ..... 2002-351635

(51) Int. Cl.
*A47L 9/18* (2006.01)
*B01D 7/02* (2006.01)

(52) U.S. Cl. ..... 15/353; 96/333

(58) Field of Classification Search ..... 15/353; 96/333, 334, 359

See application file for complete search history.

(56) References Cited

U.S. PATENT DOCUMENTS 2,221,572 A * 11/1940 Brock et al. ..... 96/333
4,640,697 A * 2/1987 Erickson, Jr. ..... 96/333
5,902,386 A 5/1999 Gustafson et al.
2002/0152893 A1 10/2002 Alberts, III et al.
2004/0068826 A1* 4/2004 Howie et al. ..... 15/353

FOREIGN PATENT DOCUMENTS

| | | |
|---|---|---|
| EP | 0 890 335 | 1/1999 |
| EP | 1 219 223 | 7/2002 |
| JP | 11-032950 | 2/1999 |
| JP | 11-32950 | 2/1999 |
| JP | 2000-316766 | 11/2000 |
| WO | WO 01/97671 | 12/2001 |

* cited by examiner

*Primary Examiner*—Terrence R. Till
(74) *Attorney, Agent, or Firm*—Koda & Androlia

(57) ABSTRACT

An electric vacuum cleaner with a vacuum cleaner main body that includes a water pan which stores water for removing dust from dust-containing air, and a suction compartment made up with a main casing detachably installed on the water pan compartment, a separator that rotates in the main casing to separate air from the water, and a main fan that rotates in the main casing and sucks in dust-containing air and exhausts air, from which water has been separated by the separator, to the outside of the vacuum cleaner main body; and in this cleaner, the separator is in a round basket shape and ribs are formed in the circumferential direction with slit gaps opened between the ribs, and a reverse jet fin assembly that rotates together with the separator and causes air to jet downward toward the outer surface of the separator is provided on the upper opening of the separator.

7 Claims, 7 Drawing Sheets

ELECTRIC VACUUM CLEANER

BACKGROUND OF THE INVENTION

1. Field of the Invention

The present invention relates to an electric vacuum cleaner and more particularly to an electric vacuum cleaner that uses water as a filter to remove dust.

2. Prior Art

In one type of electric vacuum cleaner, air that is sucked in from a suction hose is forced to pass through water, thus removing dust contained in the air using the water as a filter. Such an electric vacuum cleaner typically includes, in its vacuum cleaner main body to which the suction hose is connected, a water pan and a suction compartment. The water pan stores water used as a filter, and the suction compartment sucks in air from the suction hose via the water stored in the water pan and discharges the air from which dust has been removed to the outside of the vacuum cleaner main body. The suction compartment generally comprises a suction fan which sucks in air and a separator which separates the water from the air passing through the water in the water pan and discharge only the dust-free air to the outside as is disclosed in, for example, Japanese Patent Application Laid-Open (Kokai) No. H11-32950.

Electric vacuum cleaners that remove dust from air using water as a filter have the advantage that they are efficient in removing the dust and they have high degree of cleanness of the discharged air. However, since the air is sucked in via water, they have some problems. The dust that is filtered out by the water and remains in the water pan adheres as a contaminant to the separator that is used to separate the water from the air. More specifically, the separator is typically a basket-form component, and numerous slit holes that open in the axial direction are formed in the circumferential direction; and this separator is rotated at a high speed by an electric motor when the vacuum cleaner main body is driven. Accordingly, when dust accumulate on the separator or the rotating shaft of the separator, a smooth rotation of the separator is hindered, the separator would become stuck, thus being unable to rotate.

One conceivable method to prevent the separator from being stuck is to introduce air into the interior of the vacuum cleaner main body so that such introduced air removes dust adhering to the separator and gaps between parts installed near the separator. However, since the external air that is introduced into the vacuum cleaner main body most likely contains dust, it cannot be said that the effect of this method to remove contaminants adhering to the separator and the interior of the vacuum cleaner main body is always sufficient.

SUMMARY OF THE INVENTION

Accordingly, the present invention is to eliminate the above-described problems.

The object of the present invention is to provide an electric vacuum cleaner which eliminates such a problem that a separator disposed in the vacuum cleaner main body becomes stuck due to the dust adhering to the separator and which facilitates maintenance work on the vacuum cleaner, so that the vacuum cleaner is easier to use.

The above object is accomplished by a unique structure of the present invention for an electric vacuum cleaner that has a vacuum cleaner main body including:

a water pan compartment with a water pan that stores therein water used to remove dust from dust-containing air, and a suction compartment comprised of a main casing detachably provided on the water pan compartment, a separator rotationally provided in the main casing and separates air from the water, a main fan(s) rotationally provided in the main casing so as to suck in dust-containing air and exhaust air, from which water has been separated by the separator, to outside of the vacuum cleaner main body, and a motor which rotates the main fan and the separator that are coaxially fastened to a motor shaft of the motor;

and in the present invention, the separator is formed in a shape of a basket that has a closed bottom, the separator being formed with a plurality of ribs disposed in its circumferential direction with slit gaps between the ribs, and a reverse jet fin assembly is provided on the opening of the separator so as to rotate together with the separator, thus causing air to jet downward toward the outer surface of the separator.

In the above structure, the reverse jet fin assembly includes a plurality of fins formed in a saw-tooth shape which are disposed in a circumferential direction of the flange portion of the separator; and the separator is formed so that the central portion of the bottom is raised. In addition, the outer circumferential surface of the flange on the outer circumferential surface of the separator protrudes to the same position as the outside surface of the reverse jet fin assembly.

Furthermore, in the electric vacuum cleaner of the present invention:

the main casing of the suction compartment is partitioned in a vertical direction by a partition wall into a lower chamber, in which the main fan is accommodated, and an upper chamber, in which the motor is installed, the main fan is accommodated in a fan case that communicates with the water pan compartment in which the separator is disposed, and an exhaust chamber, which is disposed on the outer circumferential side of the fan case so that the exhaust chamber communicates with the interior of the fan case, and the water pan compartment, in which the separator is disposed, are partitioned by a fan case cover that covers the undersurface side of the fan case.

In addition, in the present invention, an exhausting attachment is attachable to the rear portion of the main casing so that the exhausting attachment communicates with the exhaust chamber, thus exhausting outing from the exhaust chamber to the outside of the main casing.

DETAILED DESCRIPTION OF THE INVENTION

Preferred embodiments of the present invention will be described in detail below with reference to the accompanying drawings.

Figure 1:
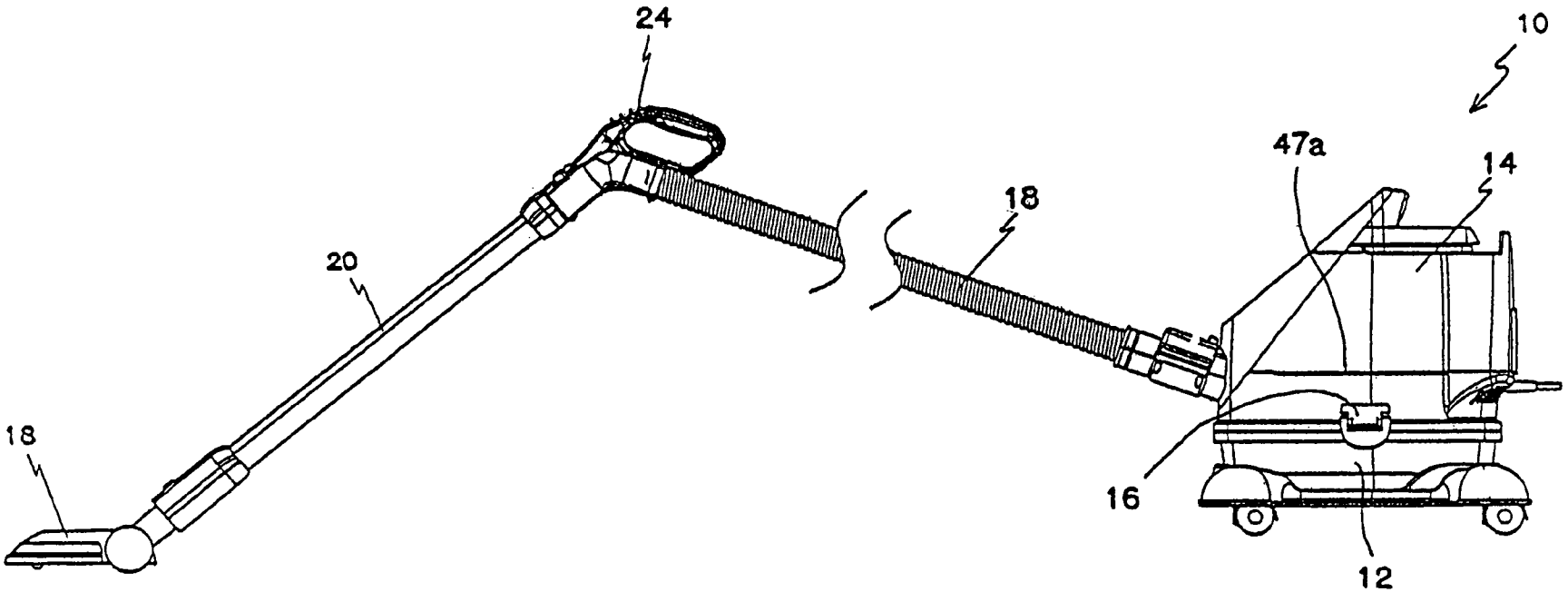
FIG. 1 shows the overall construction of the electric vacuum cleaner of the present invention.

In FIG. 1, the reference numeral 10 indicates the vacuum cleaner main body of the electric vacuum cleaner, 12 indicates a water pan compartment which is disposed in the bottom of the vacuum cleaner main body 10, and 14 indicates a suction compartment which is mounted on the upper portion of the water pan compartment 12.

The water pan 12' of the water pan compartment 12 accommodates water that removes dust from the air that is sucked into the vacuum cleaner main body 10. The suction compartment 14 sucks air that contains dust into the water pan 12 and discharges this air to the outside of the vacuum cleaner main body 10 after the dust is removed.

The water pan compartment 12 and the suction compartment 14 are disposed so as to be detachable from each other. In other words, the suction compartment 14 is set on the water pan compartment 12, and the suction compartment 14 and water pan 12 are fastened to each other with an air seal in between by a locking mechanism 16. Since dust-containing air is sucked into the vacuum cleaner main body 10 by a main fan that is installed inside the vacuum cleaner main body 10, it is necessary that the vacuum cleaner main body 10 be air-tight with reference to the outside.

A connecting hose 18 is detachably connected to the vacuum cleaner main body 10, a suction pipe 20 is connected to the tip end of the connecting hose 18. A suction head 22 is attached to the tip end of the suction pipe 20, and the suction pipe 20 is operated by a handle 24 disposed on the base end of the suction pipe 20, so that dust-containing air is sucked into the vacuum cleaner main body 10 from the suction head 22. An operation switch (not shown) is disposed near the handle 24. The operation switch and an electric motor installed inside the vacuum cleaner main body 10 are electrically connected via wiring which is wrapped in spiral form around the outer circumference of the connecting hose 18, so that the suction mechanism of vacuum cleaner can be controlled by the operation of the operation switch.

Figure 2:
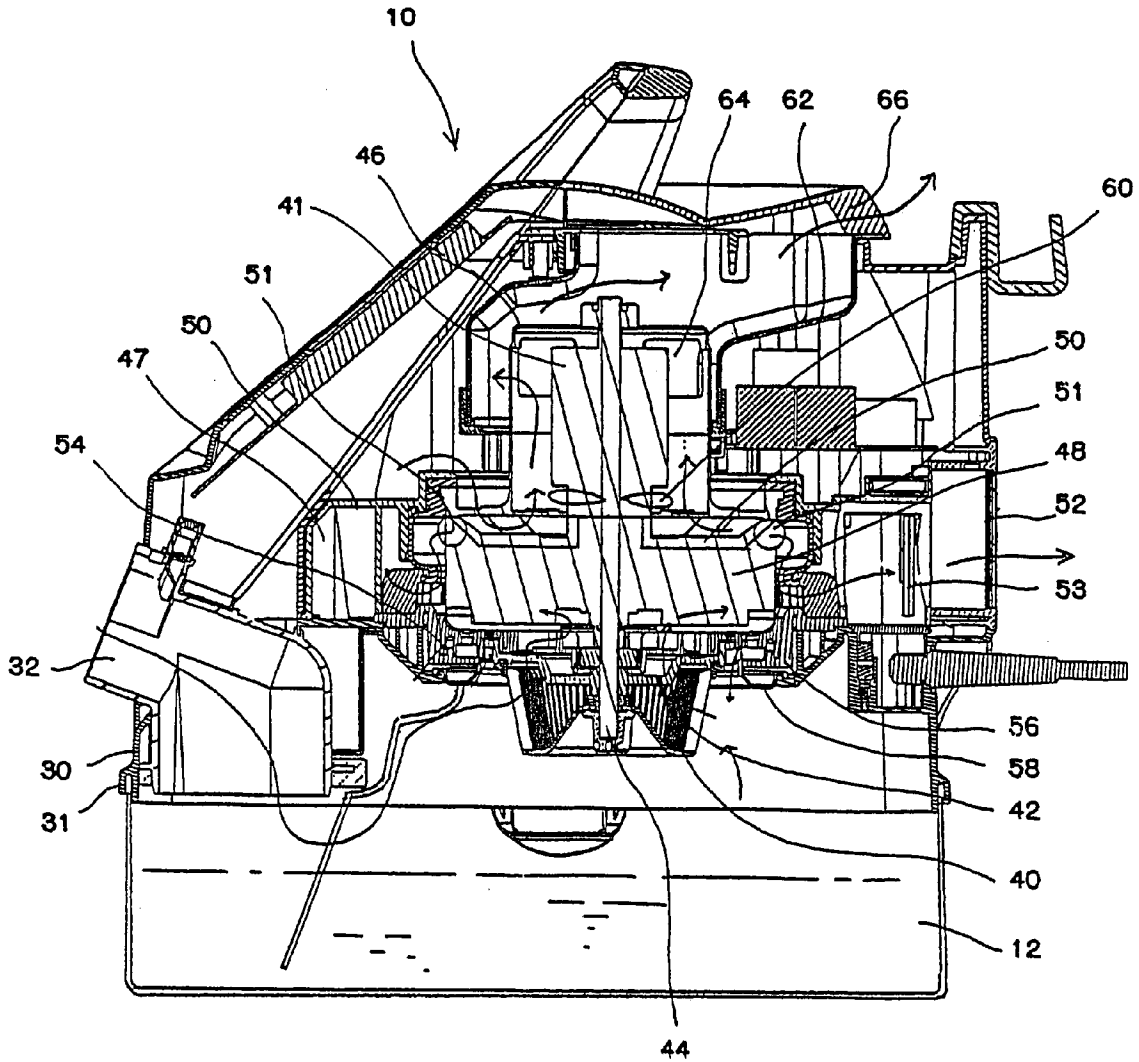
FIG. 2 shows the internal structure of the vacuum cleaner main body.

FIG. 2 shows the internal construction of the vacuum cleaner main body 10. The reference numeral 30 is a main casing of the suction compartment 14, and 31 refers to an engagement groove which is formed in the edge of the lower end of the main casing 30. The water pan 12 is detachably engaged with this engagement groove 31 at its upper edge.

A connecting duct 32 is formed in the lower portion of the front panel of the main casing 30. The connecting hose 18 is detachably connected to the connecting duct 32. The connecting duct 32 is disposed inside the main casing 30 of the suction compartment 14 and extends while curving downward toward the water pan 12' that forms the water pan compartment 12, so that dust-containing air is fed toward the water pan 12.

The suction mechanism of the vacuum cleaner main body 10 and the wiring disposed on the connecting hose 18 are electrically connected when the base end of the connecting hose 18 is inserted in the connecting duct 32.

Figure 3:
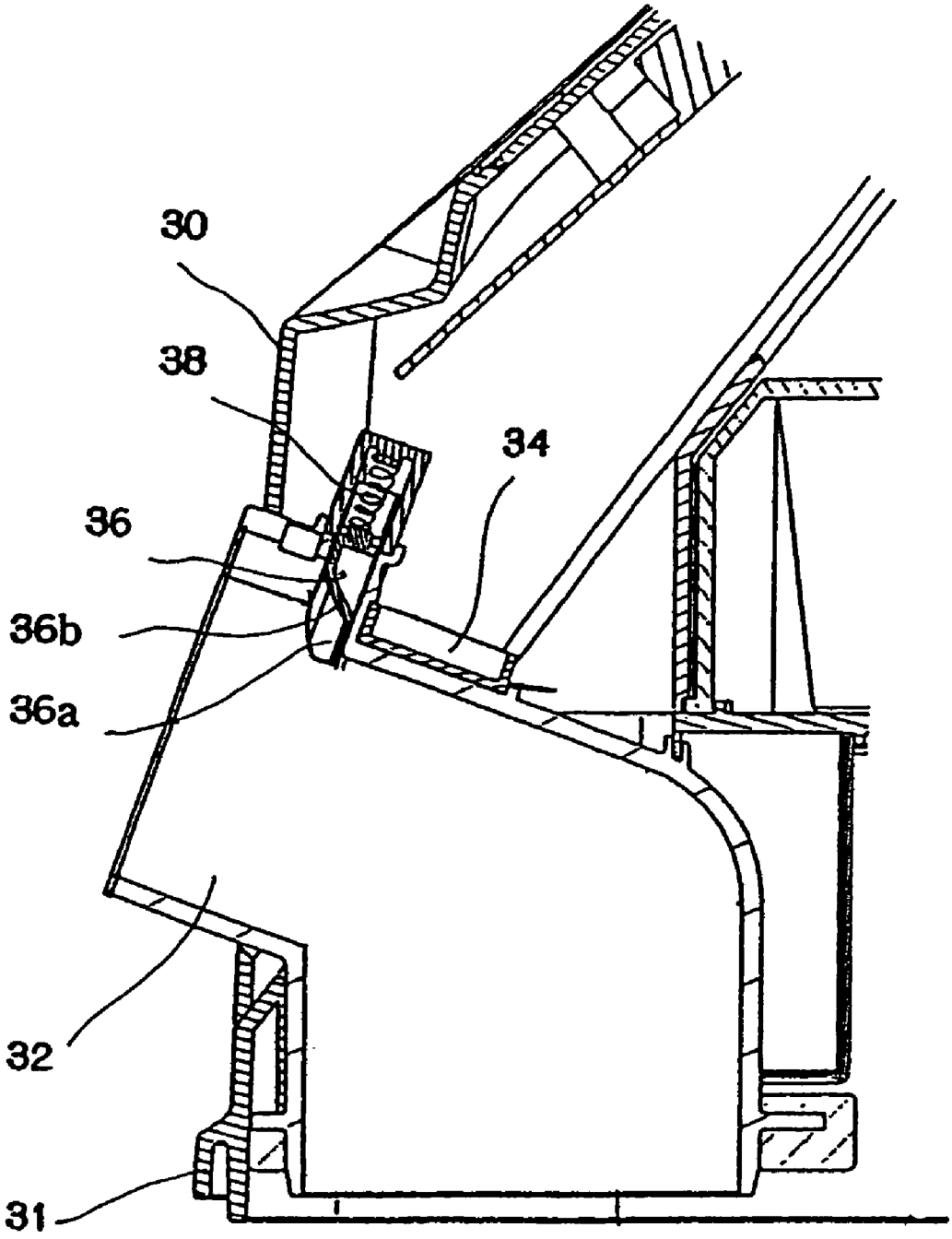
FIG. 3 shows the connection between the connecting duct and the connecting hose.

FIG. 3 shows the connecting duct 32 to which the connecting hose 18 is attached. The reference numeral 34 indicates a connecting terminal (not shown) into which an insertion pin (not shown) disposed on the connecting hose 18 is inserted. The connecting terminal 34 is formed by bending two elastic flat plates into an angled C shape, so that an electrical connection is established when the insertion pin of the connecting hose 18 engages with the connecting terminal 34.

A shutter 36 forms a seal that prevents water from adhering to the connecting terminal 34 when the connecting hose 18 is not connected to the connecting duct 32. The shutter 36 is formed in an arch shape when seen from the axial direction of the connecting duct 32, and it is attached so as to slide in a direction perpendicular to the axial direction of the connecting duct 32. A spring 38 causes the inner circumference of the shutter 36 to protrude into the connecting duct 32.

The shutter 36 has a flat plate portion **36*a* at the tip end of the inner circumferential side, and it also has a tapered portion 36*b* at the intermediate portion. The flat plate portion 36*a* is disposed so that in its protruding position, the flat plate portion 36*a* closes off the connecting terminal 34 and thus prevents water from adhering to the connecting terminal 34; and in the retracted position, the flat plate portion 36*a* of the connecting terminal 34 is opened. The tapered portion 36*b* functions so that when the connecting hose 18 is inserted into the connecting duct 32, the tubular body of the connecting hose 18 contacts the tapered portion 36*b*, and the shutter 36 is pushed outward. As the connecting hose 18 is pushed in, the shutter 36 is moved into the retracted position, so that the connecting terminal 34 opens, and the insertion pin of the connecting hose 18 and the connecting terminal 34** are engaged.

On the outer circumferential surface of the connecting hose 18, a sealing element (not shown) that forms a seal between the outer surface of the connecting hose 18 and the inner circumferential surface of the connecting duct 32 is circumferentially disposed. Thus, water in the water pan 12' is prevented from entering the connecting terminal 34 when the connecting hose 18 is connected to the connecting duct 32. When the connecting hose 18 is pulled out of the connecting duct 32, the shutter 36 is caused to move to the closed position by the spring 38, so that the connecting terminal 34 is closed off, and water is thus prevented from adhering to the connecting terminal 34.

In FIG. 2, the reference numeral 40 is a separator, and the separator 40 is disposed in the lower portion of the suction compartment 14 as to face the water pan 12'. The separator 40 is rotated at a high speed about its axis, and thus it separates water from the water-containing air that has passed through the water accommodated in the water pan 12', and it allows only air to move upward.

The separator 40 is a basket-form member, and it is formed in its side surfaces with numerous slits that open in the same direction as the axis of the separator 40. In other words, numerous longitudinal ribs are formed in the separator 40, so that these ribs are disposed in the circumferential direction with slit gaps between the ribs. When the separator 40 is rotated at a high speed about its axis, the ribs on the side surface of the separator 40 rebounds water contained in the air, so that only the air passes through the slits formed between the ribs and flows upward.

The reference numeral 42 is a reverse jet fin assembly disposed so as to cover the opening of the upper portion of the separator 40. The reverse jet fin assembly 42 is rotated together with the separator 40, and air flowing into the separator 40 goes out of the separator 40 through the opening made in the reverse jet fin assembly 42.

Figure 4:
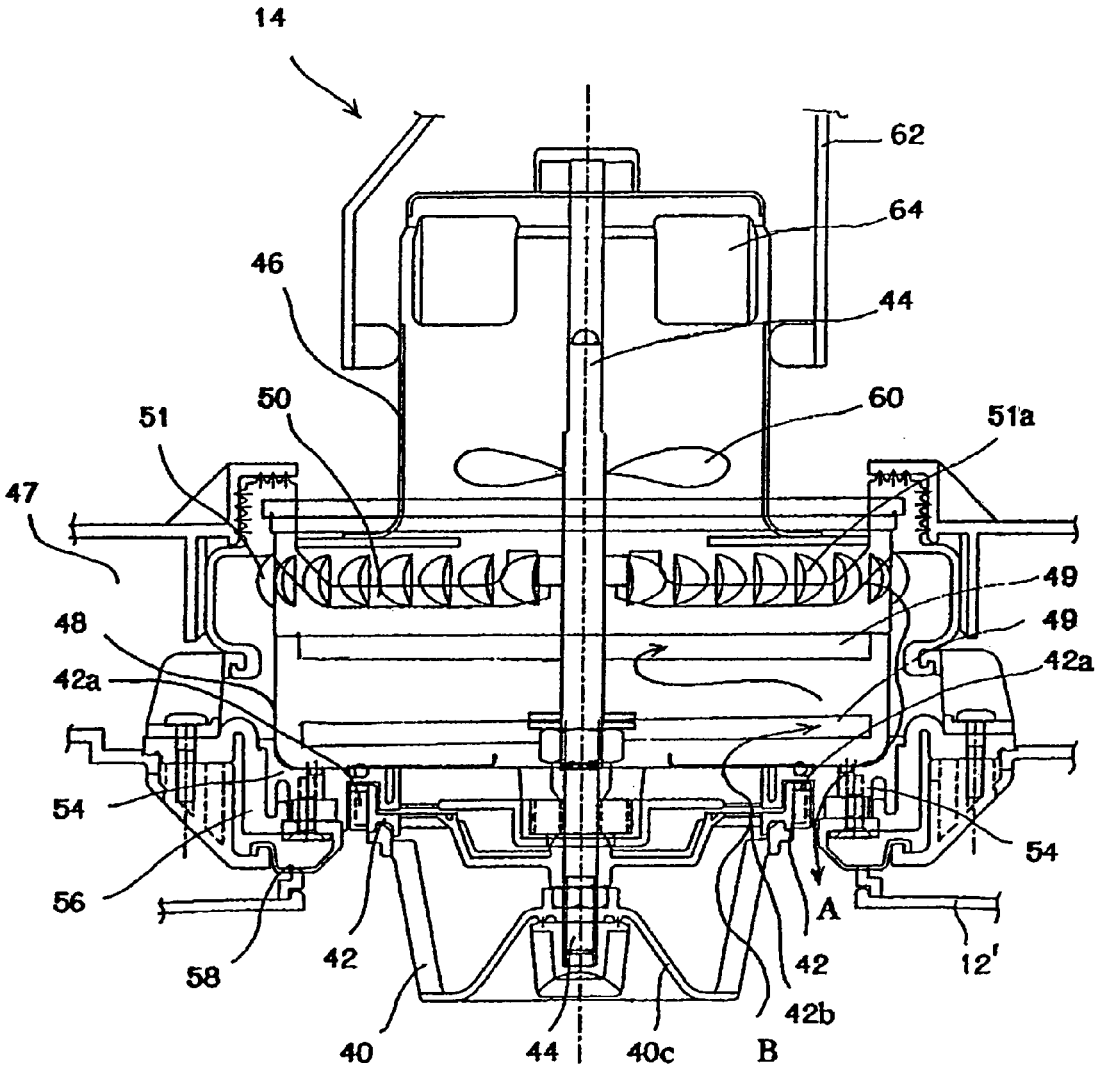
FIG. 4 shows the structure of one example of the separator and reverse jet fin assembly in addition to other parts.

The separator 40 and the reverse jet fin assembly 42 are, as see from FIG. 4, fastened to a motor shaft 44. The motor shaft 44 is directly connected to the rotor of the electric motor 41 disposed in substantially the central portion of the suction compartment 14, and the motor shaft 44 is rotated with the rotor. The motor 41 is installed in a motor case 46.

A fan case 48 is disposed between the separator 40 and the motor case 46 that accommodates the motor 41. Inside the fan case 48, upper and lower main fans 49 are mounted on the motor shaft 44 so that they are rotated as a unit with the rotor of the motor 41. The separator 40 and the fan case 48 communicate with each other at the undersurface of the fan case 48; and when the main fans 49 are rotated (at a high speed), air passing through the separator 40 from the water pan 12' is introduced into the fan case 48.

The reference numeral 51 is a flow adjusting section provided on the outer circumferential surface on the upper portion of the fan case 48. In this flow adjusting section 51, numerous openings (not shown) are formed in the wall surface of the fan case 48, and blow vanes 51*a* are formed for the respective openings so that the blow vanes 51*a* blow out air in the direction of diameter of the fan case 48. The air that flows into the fan case 48 flows out of this flow adjusting section 51 into an exhaust chamber 47 disposed outside the fan case 48, and then the air is exhausted from exhaust slits (47*a* in FIG. 1) that open in communication with the exhaust chamber 47 in the side face of the exhaust chamber 47. The exhaust slits 47*a* have a long slender shape on both side surfaces of the main casing 30.

A partition wall 50 partitions the internal space of the suction compartment 14 into two chambers, an upper chamber and a lower chamber. The air suction mechanism made up with the main fans 49, separator 40, etc. is disposed in the lower chamber formed by the partition wall 50, and the motor 41, motor case 46, controller (not shown), etc. are disposed in the upper chamber formed by the partition wall 50. As a result of the separation of the lower chamber and upper chamber by the partition wall 50, the entry of water into the upper chamber in which the motor 41 and controller are accommodated is assuredly prevented, and the safety of the vacuum cleaner main body 10 is ensured.

An outer door 52 as seen from FIG. 2 is disposed in the back (or the rear side) of the vacuum cleaner main body 10, and an inner door 53 is disposed on the inner side of the outer door 52. The outer door 52 and inner door 53 are both disposed so as to communicate with the exhaust chamber 47 on the lower side of the partition wall 50. The outer door 52 and inner door 53 open and close inward; and these doors are constantly urged outward to close the openings (not shown). Since the outer door 52 and inner door 53 are installed, the noise caused by the exhaust from the exhaust slits 47*a* is reduced. The outer door 52 and inner door 53 are used when the exhaust air from the exhaust chamber 47 is used for drying. More specifically, when an exhausting attachment equipped with a connecting tubular body is inserted into the outer door 52 and inner door 53 in the back (on the right side in FIG. 2) of the vacuum cleaner main body 10, the outer door 52 and inner door 53 open inward so that the exhaust chamber 47 and the exhausting attachment communicate with each other, and the air coming into the exhaust chamber 47 is taken out into the exhausting attachment.

The air that is exhausted from the exhaust chamber 47 is dry and clean since dust has been removed by the water in the water pan 12' and moisture has been removed by the separator 40. Accordingly, by way of extracting the air to the outside via the above-described exhausting attachment attached into the outer door 52 and inner door 53, the air can be used to dry, for instance, comforters (or Japanese futon), etc. Thus, the outer door 52 and inner door 53 are provided so that dry and clean air is extracted from the exhaust chamber 47.

A seal between the fan case 48 and the separator 40 is formed by a fan case cover 54, suspension packing 56 and a water seal 58. The fan case cover 54 covers the outer surface of the fan case 48, and the suspension packing 56 partitions the exhaust chamber 47 and the water pan compartment 12. The water seal 58 is where the flange disposed on the opening in the upper portion of the water pan 12 contacts when the suction compartment 14 is set on the water pan compartment 12. As a result, the water pan compartment is sealed off from the outside, and water-containing air that has passed through the water accommodated in the water pan 12' is sucked toward the separator 40.

Meanwhile, in the upper chamber, that is defined by the partition wall 50 and in which the motor 41, etc. is disposed, a propeller fan 60 is provided. The propeller fan 60 is coupled to the motor shaft 44 on the lower side of the rotor. The propeller fan 60 cools the motor 41 by generating an air current inside the upper chamber.

An exhaust duct 62 is disposed in the upper chamber; and a vent hole 64 is formed in the motor case 46 in which the motor 41 is disposed. After cooling the motor 41, the air current generated by the propeller fan 60 flows into the exhaust duct 62 via the vent hole 64 and is exhausted to the outside of the vacuum cleaner main body 10 via an upper exhaust port 66. The upper exhaust port 66 is formed in the upper side surface of the main casing 30, and it is in a slit form.

In the lower chamber of the vacuum cleaner main body 10, as seen from FIG. 2, dust-containing air is sucked into the water pan compartment 12 through the connecting duct 32 by the air current generated by the main fans 49. After the dust has been removed from the dust-containing air that has passed through the water in the water pan 12', the water and air are separated by the separator 40.

The air that has passed through the separator 40 is sucked into the fan case 48, exhausted into the exhaust chamber 47 through the flow adjusting section 51, and exhausted from the side surface (or the exhaust slits 47*a*) of the main casing 30. The air can be exhausted to the outside when the above-described exhausting attachment is attached to the position of the outer door 52, and as a result the inner and outer doors 53 and 52 are opened. The flow of the air is shown by curved arrows in FIG. 2.

In the upper chamber of the vacuum cleaner main body 10, a rising air current that moves toward the exhaust duct 62 is generated when the propeller fan 60 is rotated, and such an air current shown by the curved arrows in FIG. 2 is generated.

FIG. 4 shows the separator 40, reverse jet fin assembly 42, fan case cover 54, suspension packing 56, water seal 58, etc. that make the characterizing construction of the present invention.

Figure 5A:
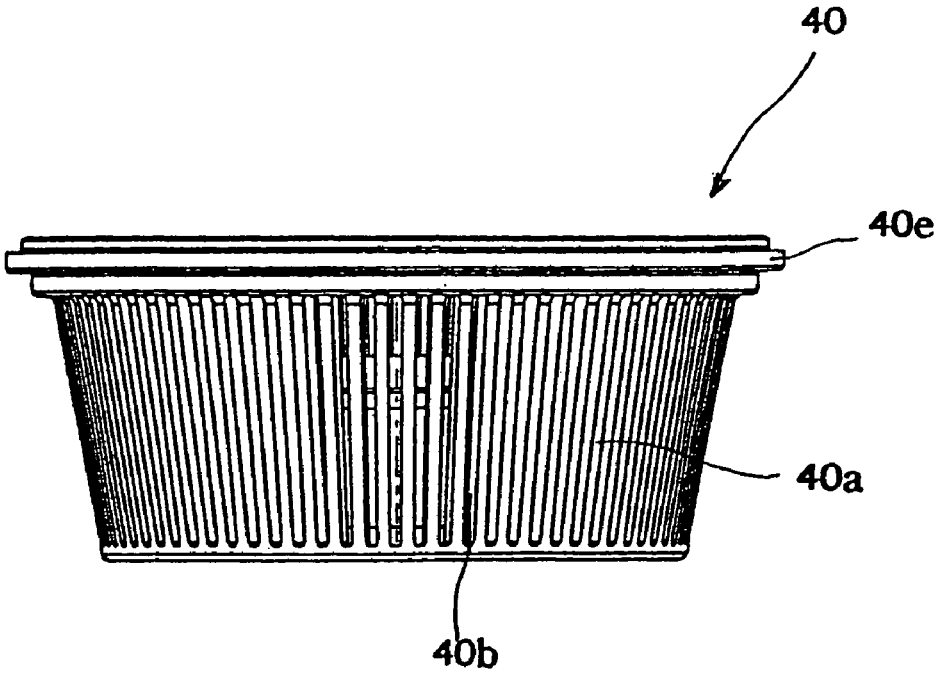
FIG. 5A is a front view of the separator.
Figure 5B:
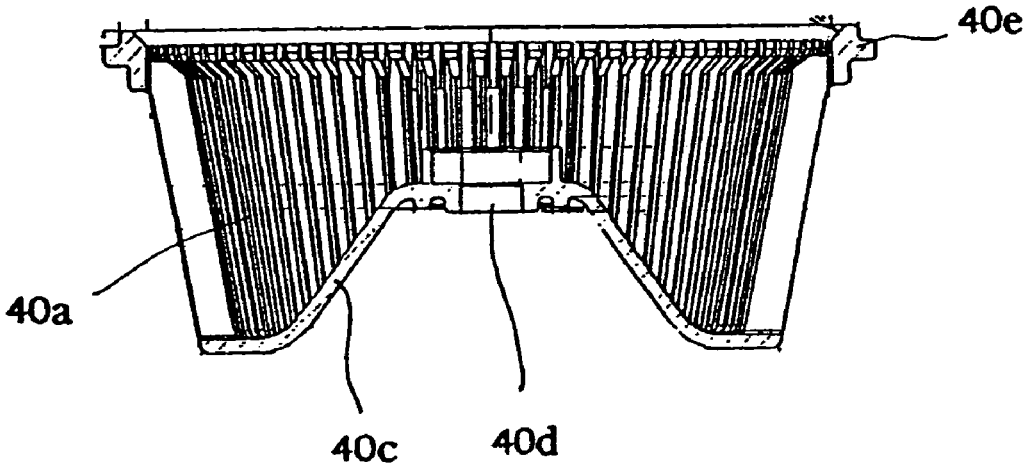
FIG. 5B is a sectional view thereof.

As described above, the separator 40 is in the shape of a basket, and numerous ribs are disposed in its circumferential direction. In FIGS. 5A and 5B, the reference numeral 40*a* refers to ribs, and 40*b* to holes in the separator 40. The separator 40 is formed so that its diameter gradually decreases downward or toward its bottom. As seen from FIG. 5B, the bottom 40*c* of the separator 40 is closed off except for the shaft attachment hole 40*d*. In other words, the motor shaft 44 is inserted into the shaft attachment hole 40*d*, and the separator is fastened to the motor shaft 44, resulting in that the bottom of the separator 40 is completely closed off.

The bottom 40*c* of the separator 40 is formed so that the central portion of the bottom 40*c* is raised and thus higher than other portions. With this structure of the separator 40 in which the central portion of the bottom 40*c* is raised, it is possible to shorten the length of the motor shaft 44 and improve the strength of the separator 40.

The reverse jet fin assembly 42 is installed to cover the upper opening of the separator 40, and it removes dust that adheres to the separator 40, fan case cover 54, suspension packing 56, water seal 58, etc.

The dust in the dust-containing air that is introduced into the water pan compartment 12 is removed by the water accommodated in the water pan 12'. However, since the air is sucked in together with the water toward the separator 40 by the air current made by the main fans 49, the dust contained in the water would fly toward the separator 40. As a result, dust adheres to the outer surface of the separator 40; and since the upper portion of the separator is disposed in close proximity to the suspension packing 56 and water seal 58, if dust adheres to the upper portion of the separator 40, the separator 40 may become unable to rotate smoothly, and in some cases the separator 40 does not rotate.

So as to avoid above problem with the separator 40, the reverse jet fin assembly 42 is provided. The reverse jet fin assembly 42 is, as shown in FIG. 4, provided so that it covers the upper portion of the separator 40 and a flange portion 42*a* (see FIG. 6B) formed on the outer circumferential edge of the reverse jet fin member 42 enters a groove formed in the bottom of the fan case cover 54.

As shown in FIG. 4, since the separator 40 is for separating water from the air that contains water sucked up from the water in the water pan 12', it is necessary to avoid the air that contains water from passing through the separator 40 into the fan case 48. The reason that the flange portion 42*a* of the reverse jet fin assembly 42 is fitted in the groove formed in the fan case cover 54 is to introduce the air into the separator 40 through the circumference thereof and not to allow air to enter into the separator 40 from the upper portion of the separator 40. Accordingly, the gap between the reverse jet fin assembly 42 and the fan case cover 54 is set as small as possible; and thus, contaminated water would enter into this narrow gap area, so that dust accumulates.

Figure 6A:
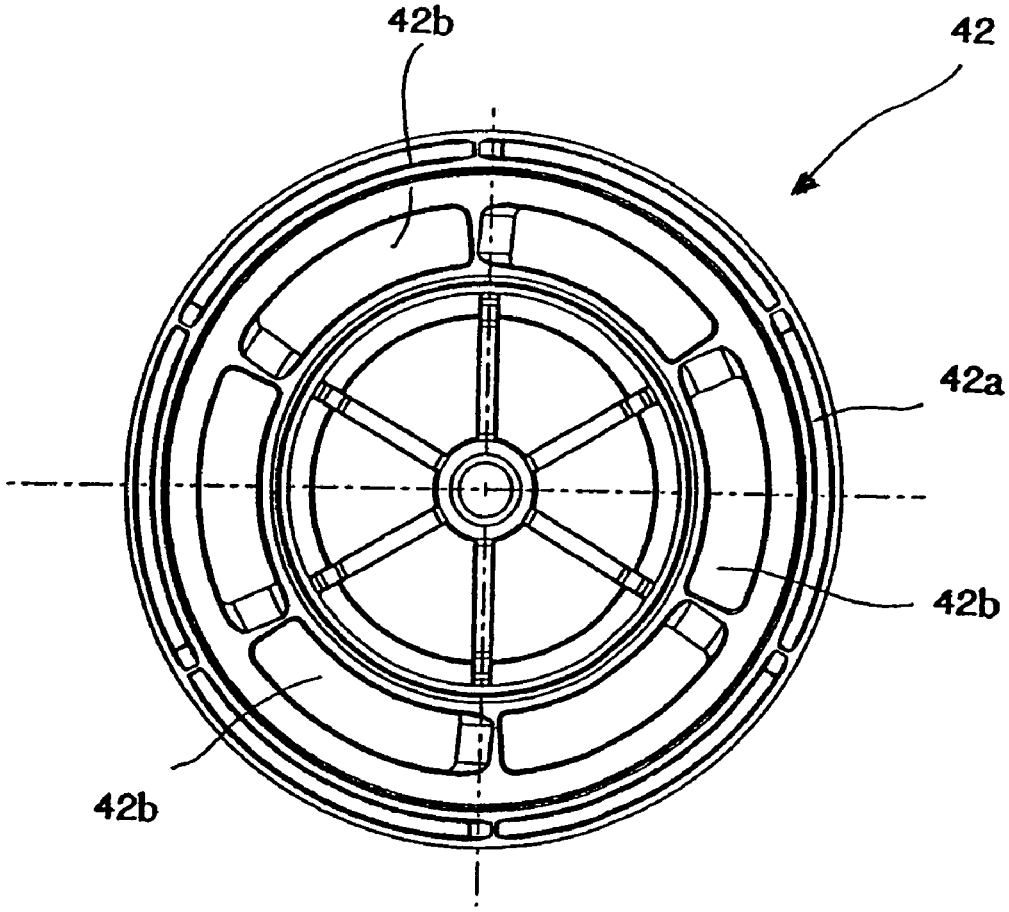
FIG. 6A is a top view of the reverse jet fin assembly.
Figure 6B:
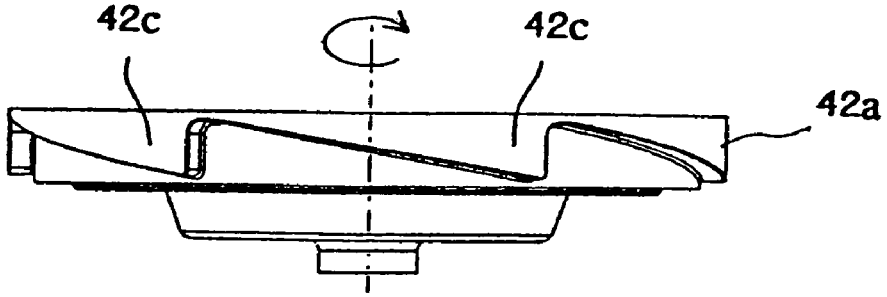
FIG. 6B is a side view thereof.

So as to solve the above problem with the small gap between the reverse jet fin assembly 42 and the fan case cover 54, the reverse jet fin assembly 42 has a characteristic structure. FIGS. 6A and 6B show the detail of the reverse jet fin assembly 42.

As seen from FIG. 6A, the reverse jet fin assembly 42 is in a circular dish shape, and it has a flange portion 42*a* formed on the circumferential edge. Openings 42*b* are formed on the inside of the flange portion 42*a*. These openings 42*b* constitute passage holes that allow the air flowing into the separator 40 from the slit holes 40*b* to pass through the reverse jet fin assembly 42 into the fan case 48. As seen from FIG. 6B, a plurality of fins 42*c* which are formed in a saw-tooth shape are formed in the circumferential direction on the outside surface of the flange portion 42*a* of the reverse jet fin assembly 42, so that a downward-oriented air current is generated when the reverse jet fin assembly 42 is rotated.

Since the reverse jet fin assembly 42 is rotated at a high speed in one direction together with the separator 40, a downward-oriented air current is generated by the fins 42*c* of the reverse jet fin assembly 42 when the separator 40 is rotated, and contaminated water that would be raised above the separator 40 along the outer surface of the separator 40 is pushed down by this downward jetting air, and thus dust is prevented from adhering to the outer surface of the separator 40; and further, dust is prevented from entering and adhering to the gap between the reverse jet fin assembly 42 and the fan case cover 54.

With this jetting air made by the reverse jet fin assembly 42, contaminated water does not enter the exhaust chamber 47 in which the main fans 49 are disposed, and dust is prevented from adhering to the separator 40; in addition, by way of letting air enter into the water pan compartment 12, in which the separator 40, etc. is disposed, from the exhaust chamber 47 in which the main fans 49 are disposed, dust is prevented from adhering to the parts near the separator 40.

When the pressure in the exhaust chamber 47 in which the main fans 49 are disposed and the pressure in the water pan compartment 12 are compared, the pressure in the exhaust chamber 47 is far higher than the pressure in the water pan compartment 12. Accordingly, when the vacuum cleaner is operated, air advances, a small amount at a time, into the water pan compartment 12 from the exhaust chamber 47. The curved arrow A in FIG. 4 shows how the air advances into the water pan compartment 12 from the exhaust chamber 47 via the gap between the fan case cover 54 and the outer surface of the fan case 48. This air that thus advances into the water pan compartment 12 from the exhaust chamber 47 is clean air from which dust has been removed. Accordingly, it pushes out the dust adhering to the separator 40, reverse jet fin assembly 42 and the above-described small gaps.

Figure 7:
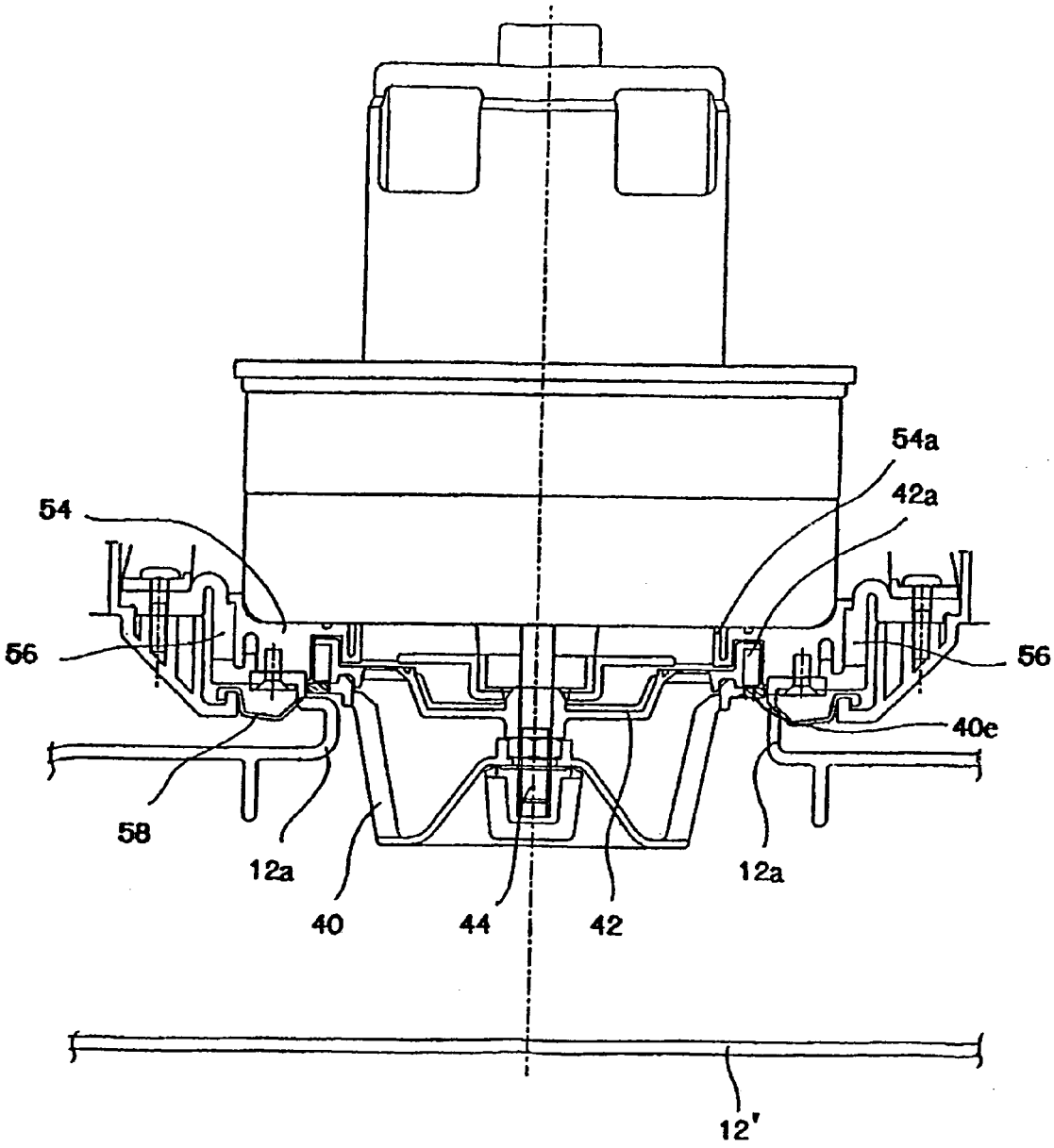
FIG. 7 shows another example of the structure of the separator and the reverse jet fin assembly along with other parts.

FIG. 7 shows another embodiment of the present invention that prevents dust from the separator 40.

In the separator 40 shown in FIG. 7, the width of the flange 40*e* disposed on the upper portion of the separator 40 is broader than the one described in the above embodiment, so that the gap between the outer circumferential surface of the flange 40*e* and the suspension packing 56 is smaller. As a result of this smaller gap between the flange 40*e* and the suspension packing 56, it is unlikely that contaminated water advance toward the reverse jet fin assembly 42. In addition, since the air caused to jet by the reverse jet fin assembly 42 is blown out through such a narrow gap, the blowing action functions more effectively, and dust is more efficiently prevented from adhering to the separator 40.

Furthermore, as a result of the larger width flange 40*e* of the separator 40, the external diameter of the flange 40*e* is greater than the internal diameter of the inner circumferential edge 54*a* of the fan case cover 54, and the air path whereby air advances into the water pan compartment 12 from the exhaust chamber 47 takes a curved shape. As a result, contaminated water is even more assuredly prevented from advancing into the exhaust chamber 47 from the water pan compartment 12.

In the embodiment shown in FIG. 7, the diameter of the upper opening 12*a* of the water pan 12' is set to be as small as possible, so that the upper opening 12*a* of the water pan 12' contacts the water seal 58 in a position near the inner circumferential edge of the water seal 58. By way of minimizing the inner diameter of the upper opening 12*a* of the water pan 12, contaminated water tends not to contact the parts other than the separator 40, and contaminated water is efficiently prevented from entering the exhaust chamber 47.

In the electric vacuum cleaner of the present invention, the reverse jet fin assembly 42 is rotated as a unit with the separator 40, the adhesion of dust to the outer surface of the separator 40 is prevented by the jetting air created by the reverse jet fin assembly 42, and dust is prevented from adhering to the gaps between the separator 40, fan case cover 54, suspension packing 56, etc. Thus, there is no difficulty in letting the separator 40 to rotate smoothly, and the separator 40 is prevented from being stuck. Cleaning of the elements near the separator 40 is generally bothersome; however, in the electric vacuum cleaner of the present invention, since the dust is prevented from adhering to the outer surface of the separator 40, maintenance work is simple, and it is easy to use the electric vacuum cleaner.

As seen from the above, in the electric vacuum cleaner of the present invention, a reverse jet fin assembly is provided on the separator, and thus dust is prevented from adhering to the outer surface of the separator. Accordingly, smooth rotation of the separator is ensured, and the separator is prevented from being stuck. Thus, the electric vacuum cleaner is reliable, easy to use and easy in its maintenance.

The invention claimed is:

1. An electric vacuum cleaner with a vacuum cleaner main body that comprises:

a water pan compartment comprising a water pan which stores therein water used to remove dust from dust-containing air, and a suction compartment comprised of:

a main casing that is detachably provided on said water pan compartment, a separator that is rotationally provided in said main casing so as to separate air from said water, and a main fan that is rotationally provided in said main casing and sucks in dust-containing air and exhausts air, from which water has been separated by said separator, to outside of said vacuum cleaner main body; wherein said separator is formed in a shape of a basket with a bottom, in which a plurality of ribs are formed in a circumferential direction thereof with slit gaps between said ribs, and a reverse jet fin assembly that rotates together with said separator and causes air to jet downward toward an outer surface of said separator is provided on an opening of said separator; and said reverse jet fin assembly comprises a plurality of fins formed in a saw-tooth shape which are disposed in a circumferential direction of a flange portion of said reverse jet fin assembly.

2. The electric vacuum cleaner according to claim 1, wherein a central portion of said bottom of said separator is raised.

3. The electric vacuum cleaner according to claim 1, wherein an outer circumferential surface of a flange formed on an outer circumferential surface of said separator protrudes to the same position as outside surfaces of said reverse jet fin assembly.

4. The electric vacuum cleaner according to claim 3, wherein said main fan is accommodated in a fan case that communicates with said water pan compartment in which said separator is disposed, and an exhaust chamber, which is disposed on an outer circumferential side of said fan case so that said exhaust chamber communicates with an interior of said fan case, and said water pan compartment, in which said separator is disposed, are partitioned by a fan case cover that covers an undersurface side of said fan case.

5. The electric vacuum cleaner according to claim 4, wherein said main casing is provided with an outer door and said exhaust chamber is provided with an inner door so that air from which said dust and water have been removed is exhausted to an outside of said vacuum cleaner main body through said outer door and inner door when said door are opened.

6. The electric vacuum cleaner according to claim 1 or 2, wherein said main fan is accommodated in a fan case that communicates with said water pan compartment in which said separator is disposed, and an exhaust chamber, which is disposed on an outer circumferential side of said fan case so that said exhaust chamber communicates with an interior of said fan case, and said water pan compartment, in which said separator is disposed, are partitioned by a fan case cover that covers an undersurface side of said fan case.

7. The electric vacuum cleaner according to claim 6, wherein said main casing is provided with an outer door and said exhaust chamber is provided with an inner door so that air from which said dust and water have been removed is exhausted to an outside of said vacuum cleaner main body through said outer door and inner door when said door are opened.

* * * * *